US011823854B2

(12) United States Patent
Marlin et al.

(10) Patent No.: US 11,823,854 B2
(45) Date of Patent: Nov. 21, 2023

(54) CUT-OFF DEVICE WITH PLASMA CHAMBER

(71) Applicant: ARIANEGROUP SAS, Les Mureaux (FR)

(72) Inventors: Frédéric Marlin, Le Haillan (FR); Romain Lorenzon, Le Haillan (FR); Jean-François Oeuvrard, Lyons (FR); Guillaume Lemmel, Villeurbanne (FR); Patrice Fleureau, Mions (FR)

(73) Assignee: ARIANEGROUP SAS, Les Mureaux (FR)

( * ) Notice: Subject to any disclaimer, the term of this patent is extended or adjusted under 35 U.S.C. 154(b) by 0 days.

(21) Appl. No.: 17/999,817

(22) PCT Filed: May 24, 2021

(86) PCT No.: PCT/FR2021/050941
§ 371 (c)(1),
(2) Date: Nov. 23, 2022

(87) PCT Pub. No.: WO2021/240104
PCT Pub. Date: Dec. 2, 2021

(65) Prior Publication Data

US 2023/0197383 A1 Jun. 22, 2023

(30) Foreign Application Priority Data

May 28, 2020 (FR) ..... 2005651

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC .... H01H 39/006; H01H 39/00; H01H 39/002; H01H 39/004; H01H 2009/008; H01H 9/342
(Continued)

(56) References Cited

U.S. PATENT DOCUMENTS 4,224,487 A * 9/1980 Simonsen ..... H01H 39/006 200/61.08
5,783,987 A * 7/1998 Kern ..... H01H 39/00 337/403
(Continued)

FOREIGN PATENT DOCUMENTS

FR 3017240 A1 8/2015
FR 3081255 A1 11/2019
WO 2021/014088 A1 1/2021

OTHER PUBLICATIONS

International Search Report and Written Opinion issued in International Application No. PCT/FR2021/050941 dated Aug. 3, 2021, with English Translation (11 pages).

*Primary Examiner* — William A Bolton
(74) *Attorney, Agent, or Firm* — Bookoff McAndrews, PLLC

(57) ABSTRACT

The invention relates to a cut-off device comprising: a conductive element and a movable piston, the piston being able to move between a first position in which the current passes in the conductive element and a second position in which the current is cut off, the piston being configured to break the conductive element when moving from its first position to its second position, the piston being positioned in a receiving cavity of a receiving element when said piston is in its second position, characterized in that the receiving element further comprises at least one additional cavity separate from the receiving cavity and linked to said receiving cavity by
(Continued)

at least one channel, said at least one channel being open when the conductive element is broken by the piston.

12 Claims, 3 Drawing Sheets

(58) Field of Classification Search
USPC ..... 200/61; 218/95, 111, 94
See application file for complete search history.

(56) References Cited

U.S. PATENT DOCUMENTS

| | | | | |
|---|---|---|---|---|
| 7,078,635 | B2 * | 7/2006 | Kordel | H01H 39/006 200/61.08 |
| 9,236,208 | B2 * | 1/2016 | Ukon | H01H 39/006 |
| 9,324,522 | B2 * | 4/2016 | Nakamura | H01H 39/006 |
| 9,905,383 | B2 * | 2/2018 | Hori | B60L 3/0007 |
| 10,128,074 | B2 * | 11/2018 | Lorenzon | H01H 71/025 |
| 10,424,448 | B2 * | 9/2019 | Goldman | H01H 9/342 |
| 10,622,176 | B2 | 4/2020 | Volkmann et al. | |
| 2019/0244778 | A1 * | 8/2019 | Dariavach | H01H 39/006 |
| 2020/0035437 | A1 * | 1/2020 | Gaudinat | H01H 39/00 |

* cited by examiner

[Fig. 1]
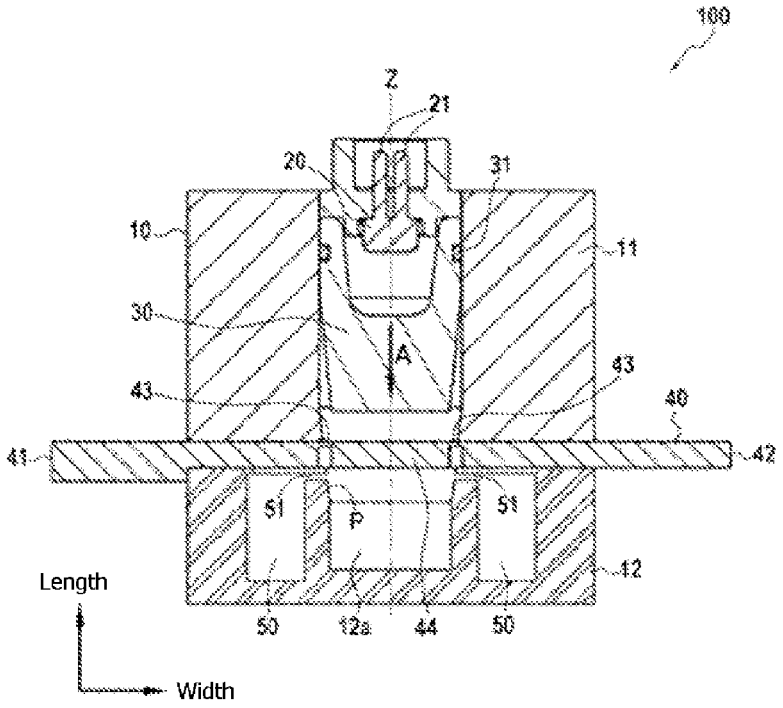
[Fig. 2]
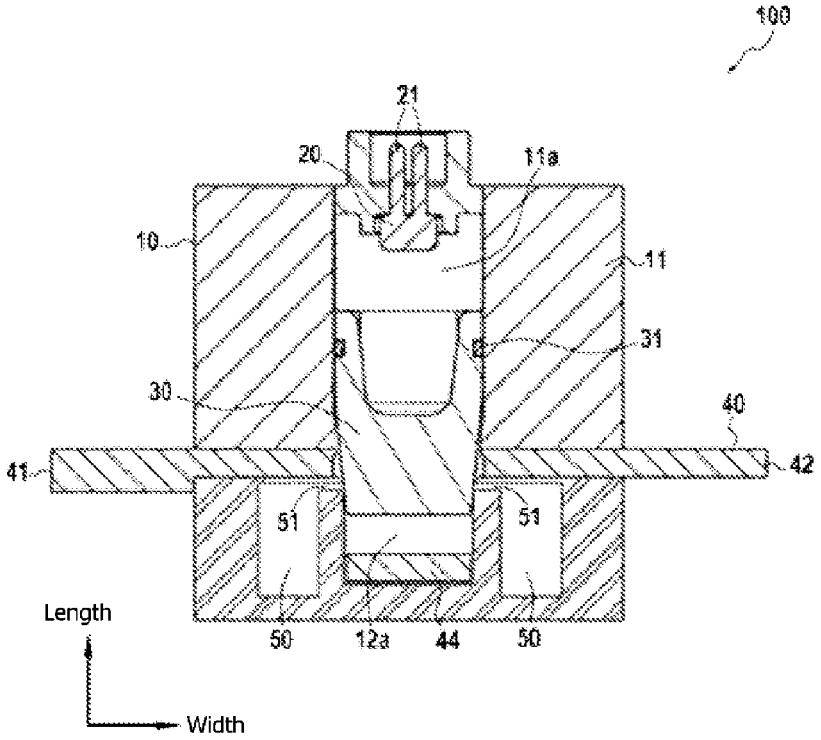

[Fig. 3]
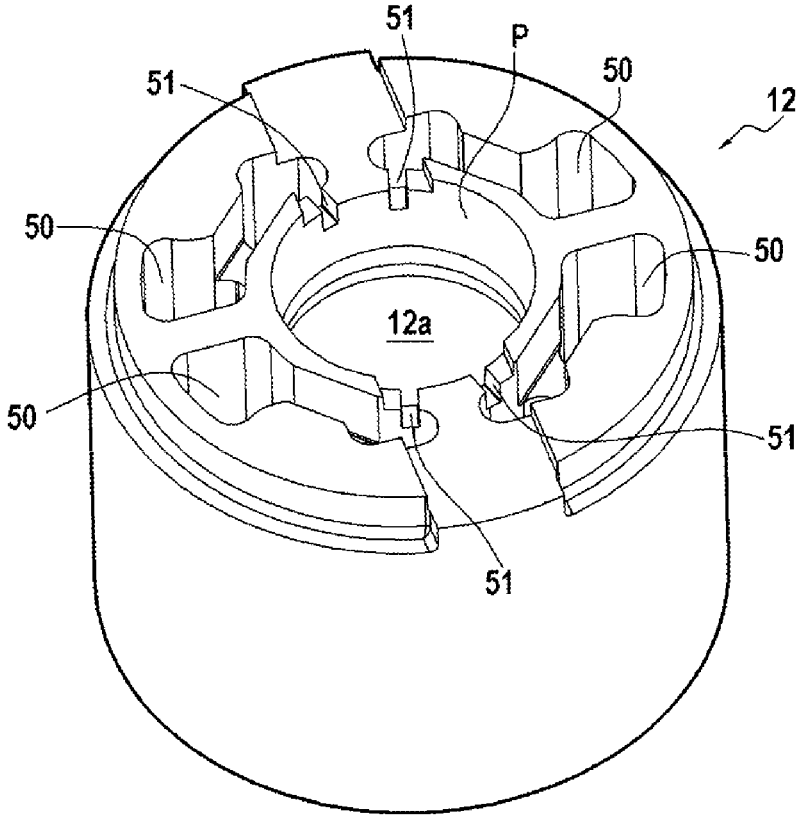
[Fig. 4]
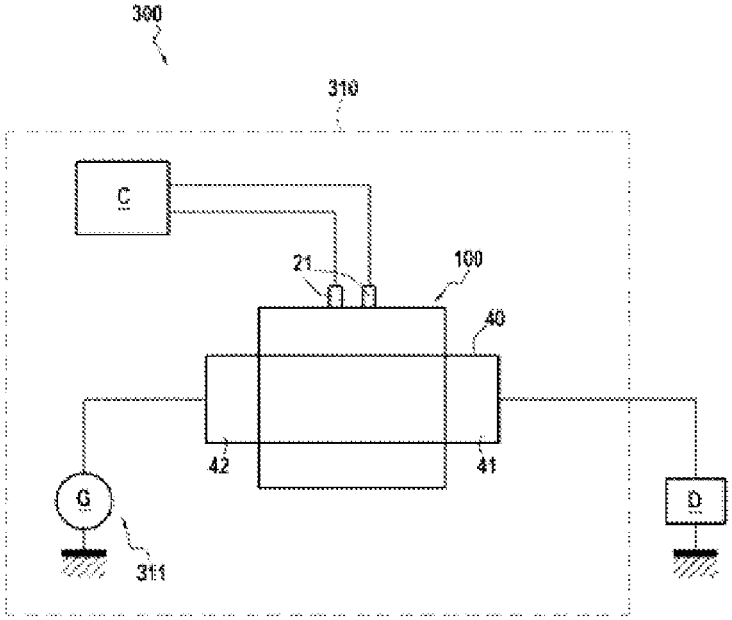

[Fig. 5]
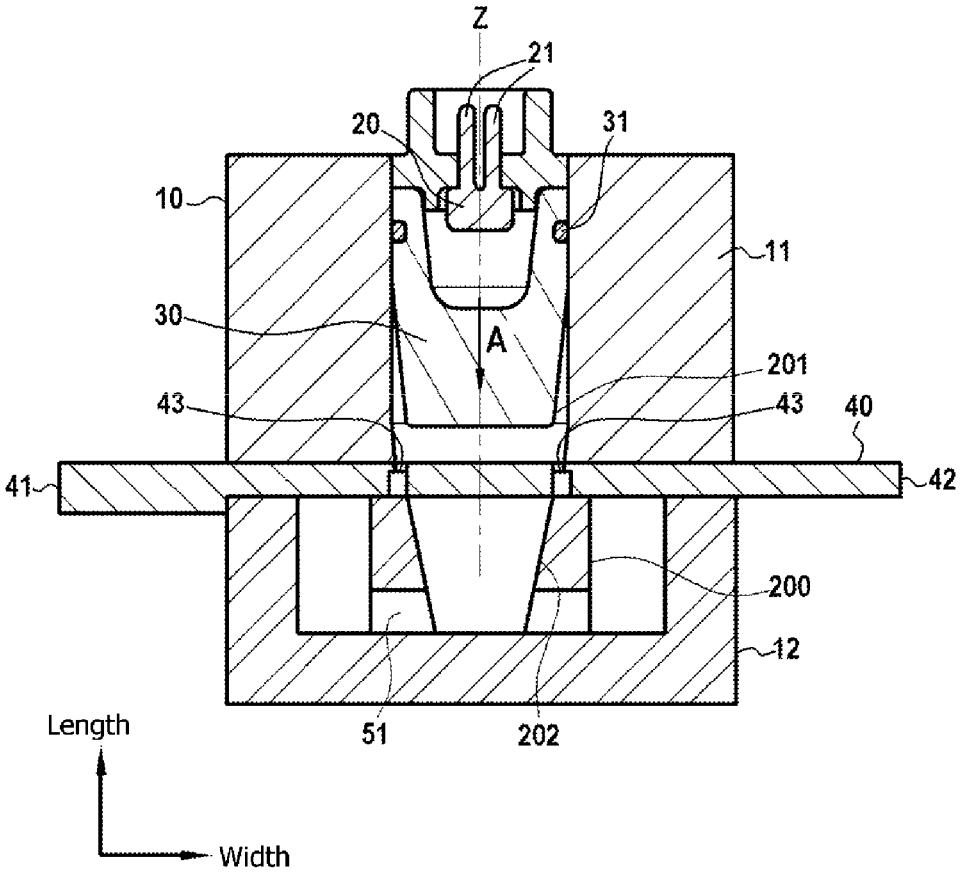

CUT-OFF DEVICE WITH PLASMA CHAMBER

CROSS-REFERENCE TO RELATED APPLICATION(S)

This patent application is a U.S. National Stage entry of International Application No. PCT/FR2021/050941, filed on May 24, 2021, which claims priority to French Application No. FR2005651, filed on May 28, 2020.

TECHNICAL FIELD

The present invention relates to the general field of electrical cut-off devices, and more particularly those of the pyrotechnically actuated type.

PRIOR ART

Pyrotechnic cut-off devices comprising a body in which there is a pyrotechnic initiator configured, when triggered, to set in motion a piston provided with a relief in the direction of a conductive bar to be severed, are known.

For example, the document filed under the number FR1908466 describing a pyrotechnic cut-off device is known. The device presented in the known document FR1908466 allows obtaining satisfactory results, in particular for voltages greater than 500 V and intensities greater than 10 kA. However, the Applicant has noticed that the generation of plasma caused when the conductive bar breaks tends to limit the electrical cut-off.

Thus, there is thus a need for a cut-off device which is more reliable at high voltages and high intensities.

DISCLOSURE OF THE INVENTION

To this end, the invention proposes a cut-off device comprising: a conductive element and a movable piston, the piston being able to move between a first position in which the current passes in the conductive element and a second position in which the current is cut off, the piston being configured to break the conductive element when moving from its first position to its second position, the piston being positioned in a receiving cavity of a receiving element when said piston is in its second position, characterized in that the receiving element further comprises at least one additional cavity separate from the receiving cavity and linked to said receiving cavity by at least one channel, said at least one channel being open when the conductive element is broken by the piston.

Such a cut-off device allows discharging the plasma generated when the conductive element breaks towards the additional cavity, thus limiting the amount of plasma in the receiving cavity which tends to slow down the piston and to ensure the electrical continuity between the broken ends of the conductive element.

According to one possible characteristic, the device is a pyrotechnic cut-off device comprising a pyrotechnic initiator, the piston being able to move following the actuation of the pyrotechnic initiator between its first position and its second position.

According to one possible characteristic, the at least one channel is obturated by the piston when said piston is in its second position.

According to one possible characteristic, the at least one channel is located in line with a breaking point of the conductive element.

According to one possible characteristic, the receiving element comprises at least two separate additional cavities each linked to the receiving cavity by at least one channel.

According to one possible characteristic, the conductive element is configured to be broken by the piston at two breaking points.

According to one possible characteristic, each additional cavity is linked to the receiving cavity by at least one channel located in line with a breaking point of the conductive element, at least one channel being located in line with each breaking point of the conductive element.

According to one possible characteristic, the at least one additional cavity comprises a length at least equal to half the length of the receiving cavity.

According to one possible characteristic, the volume of the at least one additional cavity is greater than or equal to the volume of the receiving cavity.

According to one possible characteristic, the at least one channel opens out into the receiving cavity on a portion of said receiving cavity having a conical surface of a shape complementary to a portion of the piston.

According to one possible characteristic, the conductive element is configured to be broken at a breaking point and bent by the piston.

According to a second aspect, the invention relates to a secure electrical installation comprising a cut-off device according to any one of the possible characteristics and an electric circuit linked to the conductive element of said device.

According to a third aspect, the invention relates to a vehicle comprising a secure electrical installation according to any of the possible characteristics.

BRIEF DESCRIPTION OF THE DRAWINGS

FIG. 1 is a schematic representation of a sectional view of a cut-off device according to one embodiment of the invention, the piston being in the first position.

FIG. 2 corresponds to the cut-off device of FIG. 1 in which the piston is in the second position.

FIG. 3 is a perspective view of a receiving element of the cut-off device according to one possible embodiment of the invention.

FIG. 4 is a schematic representation of a secure electric circuit in which there is a cut-off device according to the invention.

FIG. 5 is a schematic representation of a sectional view of a cut-off device according to one possible embodiment of the invention.

DESCRIPTION OF THE EMBODIMENTS

As illustrated in FIGS. 1 and 2, a cut-off device 100 according to one embodiment comprises a body 10 inside which a pyrotechnic initiator 20, a piston 30 and a conductive element 40 are installed. The piston 30 is mounted so as to be movable between a first storage position and a second breaking position, the piston 30 being moved from its first position to its second position by the actuation of the pyrotechnic initiator 20. The piston 30 has the function of breaking the conductive element 40 when moving from its first position to its second position, thus cutting off the flow of the electric current passing through the conductive element 40.

The device 100 comprises a first 41 and a second 42 electrical terminal intended to be linked to an electric circuit to be cut off and which here correspond to two ends of the conductive element 40. The conductive element 40 here takes the form of an electrically conductive bar or tab. In one embodiment not illustrated, the device 100 can comprise a plurality of conductive elements. One example of installation comprising an electric circuit linked to the terminals 41 and 42 will be described in relation to FIG. 4. In order to make it easier for the piston 30 to break the conductive element 40, the conductive element 40 comprises at least one area of weakness 43 which is intended to form a breaking point of the conductive element 40. In the exemplary embodiments illustrated in the figures, the conductive element 40 comprises two areas of weakness 43, thus making it possible to ensure a break in the conductive element 40 at two breaking points and to detach a sacrificial portion 44 from the rest of the conductive element 40.

The body 10 can have a cylindrical shape with a main axis Z, as illustrated in the figures, other shapes are however possible. In the embodiment illustrated in the figures, the body 10 is formed by a storage element 11 and a receiving element 12 which are assembled together. The storage element 11 has a storage cavity 11*a* in which the piston 30 is located when the piston 30 is in its first position. The receiving element 12 has a receiving cavity 12*a* which is aligned with the storage cavity 11*a* and which communicates with said storage cavity 11*a*. The receiving cavity 12*a* is intended to receive the piston 30 when said piston 30 is in its second position, as illustrated in FIG. 2. The storage cavity 11*a* and the receiving cavity 12*a* form a housing in which the piston 30 can move and which is traversed by the conductive portion 40.

The pyrotechnic initiator 20 comprises a pyrotechnic charge linked to connectors 21. The pyrotechnic charge is able, when initiated for example using a current passing through the connectors 21, to generate a pressurizing gas by its combustion. The conductive elements 21 can be linked to a monitoring device C (FIG. 4) configured to actuate the pyrotechnic initiator 20 when an anomaly is detected.

The piston 30 has, in this example, a shape of revolution about the axis Z. The axis Z corresponds to the axis of displacement of the piston 30. The piston 30 comprises a circumferential groove in which a seal 31, for example an O-ring, is housed. The piston 30 can move in a direction of displacement A along the axis Z inside the body 10 between a high position (first position) as in FIG. 1, and a low position (second position) as in FIG. 2. As long as the pyrotechnic initiator 20 has not been triggered, the piston 30 is in its first position.

As seen in FIGS. 1 to 3, the receiving element 12 comprises at least one additional cavity 50 located around the receiving cavity 12*a* which is put into communication with said receiving cavity 12*a* by at least one channel 51. In the exemplary embodiments illustrated in the figures, the receiving element 12 comprises a plurality of additional cavities 50. The additional cavities 50 are cavities separate from the receiving cavity 12*a*, in particular the piston 30 does not penetrate into the additional cavities 50 when said piston 30 is positioned in the receiving cavity 12*a*. The channels 51 which link the additional cavities 50 to the receiving cavity 12*a* are open when the piston 30 breaks the conductive element 40, and are obturated by the piston 30 when the said piston 30 is in its second position. Such additional cavities 50 allow receiving the plasma generated when the conductive element 40 breaks, the plasma thus being discharged from the receiving cavity 12*a* towards the additional cavity(ies) 50 via the channel(s) 51. The Applicant has indeed realized that the fact that the plasma stagnates in the receiving cavity 12*a* tends on the one hand to slow down the movement of the piston 30, and on the other hand to allow the flow of the electric current despite the breaking of the conductive element 40. The fact of moving the plasma out of the receiving cavity 12*a* thus allows the device 100 to more quickly and more effectively cut off the flow of an electric current between the two terminals 41 and 42 of the conductive element, 40 and this despite the fact that the voltage and the intensity of the electric current are high (in particular a voltage greater than 500 V and an intensity greater than 10 kA) and cause the generation of plasma when the conductive element breaks 40.

Preferably, once the conductive element 40 has broken, the piston 30 then obturates the channel(s) 51, thus maintaining the plasma in the additional cavities 50, which thus limits the risk that the current continues to flow despite the cut-off of the conductive element 40.

According to one preferred characteristic allowing better discharge of the plasma towards the additional cavity(ies) 50, the channel(s) 51 is/are located in line with a breaking point of the conductive element 40. Indeed, the plasma is generated at the level of the breaking point of the conductive element 40.

The channel(s) 51 is/are preferably located close to a breaking point of the conductive element 40, thus allowing better discharge of the plasma towards the additional cavity(ies) 50. Thus, the channel(s) is/are located at a distance less than or equal to 5 mm from a breaking point of the conductive element 40.

In order to minimize the amount of plasma remaining in the receiving cavity 12*a*, the size of the additional cavity(ies) 50 is advantageously large enough relative to the size of the receiving cavity 12*a*. Thus, the additional cavity(ies) 50 has/have a length which is at least equal to the length of the receiving cavity 12*a*. Even more advantageously, the total volume of the additional cavity(ies) 50 is greater than or equal to the volume of the receiving cavity 12*a*. Preferably, the total volume of the additional cavity(ies) 50 is greater than the volume of the receiving cavity 12*a*.

According to one preferred characteristic making it possible to obtain better insulation, the receiving element 12 comprises a plurality of additional cavities 50 in order to create insulated pockets of plasma. The receiving element 12 can for example comprise four additional cavities 50, as in the example of FIG. 3.

In the embodiments illustrated in FIGS. 1 to 3, the channels 51 open out into the receiving cavity 12*a* on a portion P of said receiving cavity 12*a* which has a conical surface. The shape of the conical surface of the portion P of the receiving cavity 12*a* is complementary to the shape of a portion of the piston 30, thus making it possible to improve the sealing of the closing of the channels 51 by the piston 30.

According to one possible embodiment which is not illustrated in the figures, the conductive element 40 comprises an area of weakness 43 and is broken at a breaking point. The sacrificial portion 44 is not detached from the rest of the conductive element 40 but is bent by the piston 30 in the receiving cavity 12*a*.

FIG. 4 schematically shows one example of a secure electrical installation 300 implementing the cut-off device 100 according to the invention.

The secure electrical installation 300 comprises a secure power supply system 310 comprising the cut-off device 100 (represented very schematically) and a power supply circuit 311. The power supply circuit 311 here comprises an electric generator G linked to the second terminal 42 of the conductive portion 40 of the cut-off device 100. The electric generator G can be for example a battery or an alternator.

The secure power supply system 310 further comprises a monitoring element C configured to actuate the pyrotechnic initiator 20 when an anomaly is detected. The monitoring element C is connected to the pyrotechnic initiator 20 via connectors 21. The anomaly in response to which the monitoring element C can trigger the pyrotechnic initiator 20 may be an electrical anomaly, such as an exceeded current threshold in the circuit, or a non-electrical anomaly such as the detection of a shock, for example a sudden deceleration of the monitoring element, of a temperature, pressure change, etc. In case of detection of an anomaly, the monitoring element C is able to send an electric current to the pyrotechnic initiator 20 for its triggering in order to cut off the current, as described previously.

The secure electrical installation 300 finally comprises an electrical device D linked here to the first terminal 41 of the conductive portion 40 of the cut-off device 100 to be powered by the secure power supply system 310.

As an example, a motor vehicle can comprise a secure electrical installation 300.

According to one possible embodiment illustrated in FIG. 5, the channels 51 can be located in a low part of the receiving cavity 12*a*, the embodiment illustrated in FIGS. 1 and 2 comprising the channels 51 in the high part of the receiving cavity 12. The receiving cavity 12*a* indeed comprises a high part located at a first end and which opens out into the storage cavity 11*a* and a low part which is located at a second end, which is obturated and which receives the sacrificial portion 44 once detached from the conductive element 40. The plasma applies a pressure on the walls 200 of the additional cavities 50, thus reinforcing the sealing of the male cone 201 formed by the piston 30 with the female cone 202 formed by the receiving cavity 12*a*.

The invention claimed is:

1. A cut-off device comprising: a conductive element and a movable piston, the piston being able to move between a first position in which a current passes in the conductive element and a second position in which the current is cut off, the piston being configured to break the conductive element when moving from the first position to the second position, the piston being positioned in a receiving cavity of a receiving element when said piston is in the second position, wherein the receiving element further comprises at least one additional cavity separate from the receiving cavity and linked to said receiving cavity by at least one channel, said at least one channel being open when the conductive element is broken by the piston, the at least one channel being obturated by the piston when said piston is in the second position.

2. The device according to claim 1, wherein the device is a pyrotechnic cut-off device comprising a pyrotechnic initiator, the piston being able to move following an actuation of the pyrotechnic initiator between the first position and the second position.

3. The device according to claim 1, wherein the at least one channel is located in line with a breaking point of the conductive element.

4. The device according to claim 1, wherein the receiving element comprises at least two separate additional cavities each linked to the receiving cavity by at least one channel.

5. The device according to claim 1, wherein the conductive element is configured to be broken by the piston at two breaking points.

6. The device according to claim 1, wherein each additional cavity is linked to the receiving cavity by at least one channel located in line with a breaking point of the conductive element, at least one channel being located in line with each breaking point of the conductive element.

7. The device according to claim 1, wherein the at least one additional cavity comprises a length at least equal to half a length of the receiving cavity.

8. The device according to claim 1, wherein a volume of the at least one additional cavity is greater than or equal to a volume of the receiving cavity.

9. The device according to claim 1, wherein the at least one channel opens out into the receiving cavity on a portion of said receiving cavity having a conical surface of a shape complementary to a portion of the piston.

10. The device according to claim 1, wherein the conductive element is configured to be broken at a breaking point and bent by the piston.

11. A secure electrical installation comprising the cut-off device according to claim 1 and an electric circuit linked to the conductive element of said device.

12. A vehicle comprising the secure electrical installation according to claim 11.

* * * * *